United States Patent [19]

Drahos

[11] Patent Number: 5,053,170

[45] Date of Patent: Oct. 1, 1991

[54] FUEL ATOMIZING DEVICE FOR CARBURETORS

[76] Inventor: Lloyd J. Drahos, 98-60th Avenue N.W., Rochester, Minn. 55901

[21] Appl. No.: 594,654

[22] Filed: Oct. 9, 1990

Related U.S. Application Data

[63] Continuation-in-part of Ser. No. 495,404, Mar. 19, 1990.

[51] Int. Cl.[5] ..... F02M 19/035

[52] U.S. Cl. ..... 261/78.1; 261/DIG. 39

[58] Field of Search ..... 261/78.1, DIG. 39

[56] References Cited

U.S. PATENT DOCUMENTS

| | | | |
|---|---|---|---|
| 2,560,220 | 8/1946 | Graziano | 219/38 |
| 2,714,503 | 8/1955 | Heisler | 261/78 |
| 2,899,185 | 8/1959 | Rector | 261/72 |
| 3,012,400 | 12/1961 | Carson, Jr. | 261/78.1 |
| 3,437,467 | 8/1969 | Jacobus | 48/180 |
| 3,467,072 | 9/1969 | Toesca | 123/141 |
| 3,873,650 | 3/1975 | Lamkin | 261/78.1 |
| 3,955,545 | 5/1976 | Priegel | 123/199 |
| 4,094,934 | 6/1978 | Tuckey et al. | 261/64 |
| 4,133,849 | 1/1979 | Hecht | 261/78 |
| 4,139,582 | 2/1979 | Collins | 261/78.1 |
| 4,171,332 | 10/1979 | Gohnert | 261/DIG. 39 |
| 4,259,021 | 3/1981 | Goudy, Jr. | 366/118 |

FOREIGN PATENT DOCUMENTS

| | | | |
|---|---|---|---|
| 503520 | 6/1920 | France | 261/78.1 |
| 1008178 | 5/1952 | France | 261/78.1 |
| 56-151249 | 11/1981 | Japan | 261/78.1 |
| 0228322 | 10/1985 | U.S.S.R. | 261/78.1 |
| 81/02611 | 9/1981 | World Int. Prop. O. | 261/78.1 |

*Primary Examiner*—Tim Miles

*Attorney, Agent, or Firm*—Palmatier & Sjoquist

[57] ABSTRACT

A universal and removable fuel atomizing device for known carburetors having a venturi stack into which there exists a main fuel discharge. The fuel atomizing device is comprised of an atomizing disc preferably having a convex top surface and a substantially flat bottom surface. The disc suitably has a peripheral atomizing edge and is concentrically supported on the top lip of the venturi stack and held thereat by suitably securing means.

18 Claims, 11 Drawing Sheets

FUEL ATOMIZING DEVICE FOR CARBURETORS

BACKGROUND OF THE INVENTION

This application is a continuation-in-part of U.S. Pat. application Ser. No. 495,404, filed on Mar. 19, 1990, also by applicant.

This invention relates to a fuel atomizing device to be removably situated onto a gasoline carburetor to improve the efficiency and performance of the carburetor and associated engine.

Referring to prior art FIGS. 1 through 3A, the purpose of a carburetor on a gasoline engine is to meter, atomize and deliver the atomized gasoline or fuel to the engine. These functions are performed by the carburetor over a wide range of engine operating conditions. A thorough atomization of the gasoline fuel to be delivered into the engine will ensure peak performance and efficiency of the engine.

Although there are many manufacturers of carburetors, there remains essentially three designs in the area of the venturi structure of most carburetors. One such design is that of the ROCHESTER carburetor (FIGS. 1 and IA) which is manufactured by Rochester Carburetors Inc. of Rochester, New York. Another general design is the CARTER carburetor which is manufactured by Federal Mogul Inc. of Detroit, Michigan. This design is also similar to the MOTOCRAFT carburetor manufactured by Ford Motor Company of Dearborn, Michigan. Yet another design is the HOLLY carburetor manufactured by Holly Coltec, Inc. of Goodlettsville, Tennessee. All of these carburetors operate on essentially the same principles and have similar structure. However, slight variances exist in their venturi configurations and gas discharge within the venturies.

Referring to FIGS. 1 and 1A, the ROCHESTER carburetor 10 has a top air valve or butterfly 12 which permits air (see Arrow A) to be drawn into the engine through the carburetor by way of the partial vacuum which is created in the cylinders on the downward strokes of the pistons. As the air is drawn by the air valve 12, it must pass through the venturi stack 14 which is common to most carburetors 10. At the venturi stack 14 the air is mixed with gasoline and delivered to the engine through the throttle valve 30.

The ROCHESTER venturi stack 14 is comprised of a top boost venturi 16 with top lip 17, a bottom boost venturi 18 and a main venturi 20. As the air rushes in and through the venturi stack 14, it is constricted or necked down and the air velocity increases thereby reducing the pressure or creating an air depression inside the venturi stack 14. That is, the curved inner surfaces of the venturies 16, 18 and 20 are shaped similarly to an aircraft wing. The incoming air increases velocity as it rushes over these curved surfaces creating a depression or vacuum in the venturi stack 14.

It is this vacuum or depression in the venturi stack 14 which causes lift or suction so that the liquid fuel ($F_f$) is pulled up and out of the carburetor 10's main well 28 and through the main discharge nozzle 22. Nozzle 22 has a top opening 24 (for air) and a side opening 26 (for gas atomizing and dispersion). The gasoline fuel is then further mixed and dispersed with the incoming air in the venturi 14 region of the carburetor 10. The throttle valve 30, which is suitably of a butterfly construction, is located at the bottom of the carburetor 10 and permits the mixed air and gasoline to enter into the intake manifold and on into the cylinders of the engine The CARTER or MOTOCRAFT style of carburetor 110 is shown in FIGS. 2 and 2A. This carburetor 110 includes its air valve or butterfly 112 below which is located its venturi stack 114. The venturi stack or arrangement 114 includes boost venturi 116 having a stop lip 117 and perhaps a removable air funnel 118 shown in broken outline along with its main venturi 120. Within the boost venturi 116 is located a main discharge port 122 which is in flow communication with main well 128. Through port 122, the gasoline or liquid fuel ($F_f$) is drawn by vacuum into the boost venturi 116 to be mixed with the accelerating air (see Arrow A). Below the venturi stack 114 is located the throttle valve or butterfly 130. The MOTOCRAFT venturi may be slightly larger than the venturi of CARTER Carburetor.

The HOLLY carburetor 210 is shown in FIGS. 3 and 3A. This carburetor 210 includes its upper air valve or butterfly 212 below which is located the venturi stack 214. The stack 214 includes its top boost venturi 216 along with its top lip 217 and bottom boost venturi 218. The main venturi 220 surrounds venturies 216 and 218. At the top of top boost venturi 216 is located the main discharge port 222 which is located on the underside of discharge support bar 223 which draws liquid gasoline ($F_f$) from the main well 228. Below the venturi stack 214 is located the throttle valve or butterfly 230.

There is a need for a simple, universal, removable device which will further increase the atomization of the gasoline fuel in unaltered existing carburetors. Such a device would increase efficiency and performance of the carburetor and the associated engine.

SUMMARY OF THE INVENTION

A universal and removable fuel atomizing device for known carburetors having a venturi stack into which there exists a main fuel discharge. The fuel atomizing device is comprised of an atomizing disc preferably having a convex top surface and a substantially flat bottom surface. The disc suitably has a peripheral atomizing edge and is concentrically supported on the top lip of the venturi stack and held thereat by suitably securing means.

A principal advantage of the present invention is that the performance and efficiency of the carburetor and engine is greatly enhanced manifest by increased mileage, horsepower and engine responsiveness while hydrocarbons or raw fuel out the exhaust of the engine is reduced.

The atomizing device is extremely simple to manufacture and only takes moments to install without removal, alteration or disassembly of the carburetor. The device has no moving parts and hence has a long life and is inexpensive to manufacture.

Another advantage and object of the fuel atomizer is that it is universal in that it will fit and operate with the various venturi stack designs of known carburetors without adjustment of either the device or the carburetor.

DETAILED DESCRIPTION

Figure 1:
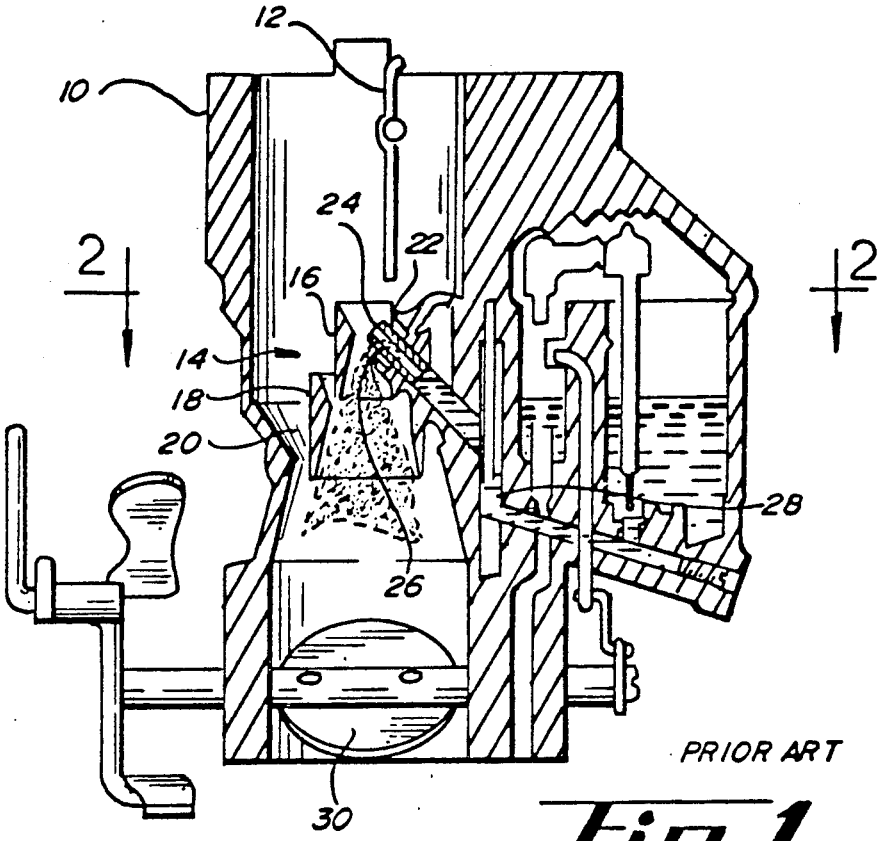
PRIOR ART Fig. 1.
FIG. 1 is a prior art cross-sectional schematic view of a ROCHESTER carburetor.
Figure 1A:
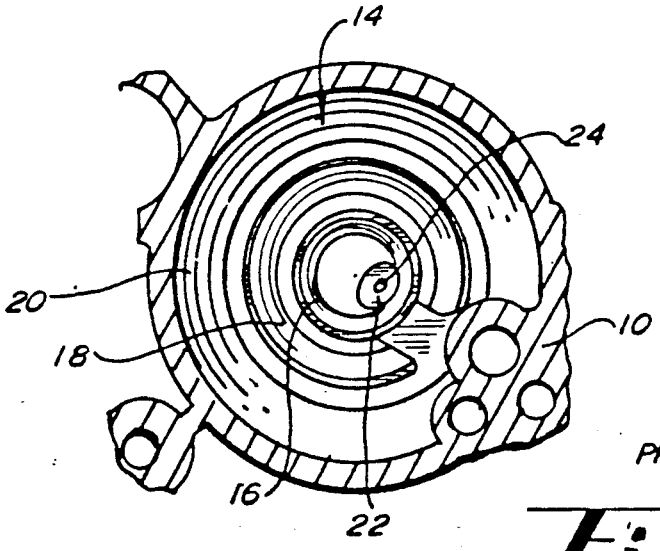
PRIOR ART Fig. 1A.
FIG. 1A is a cross-sectional view along lines 1A—1A of FIG. 1 showing a venturi stack partially broken away.
Figure 2:
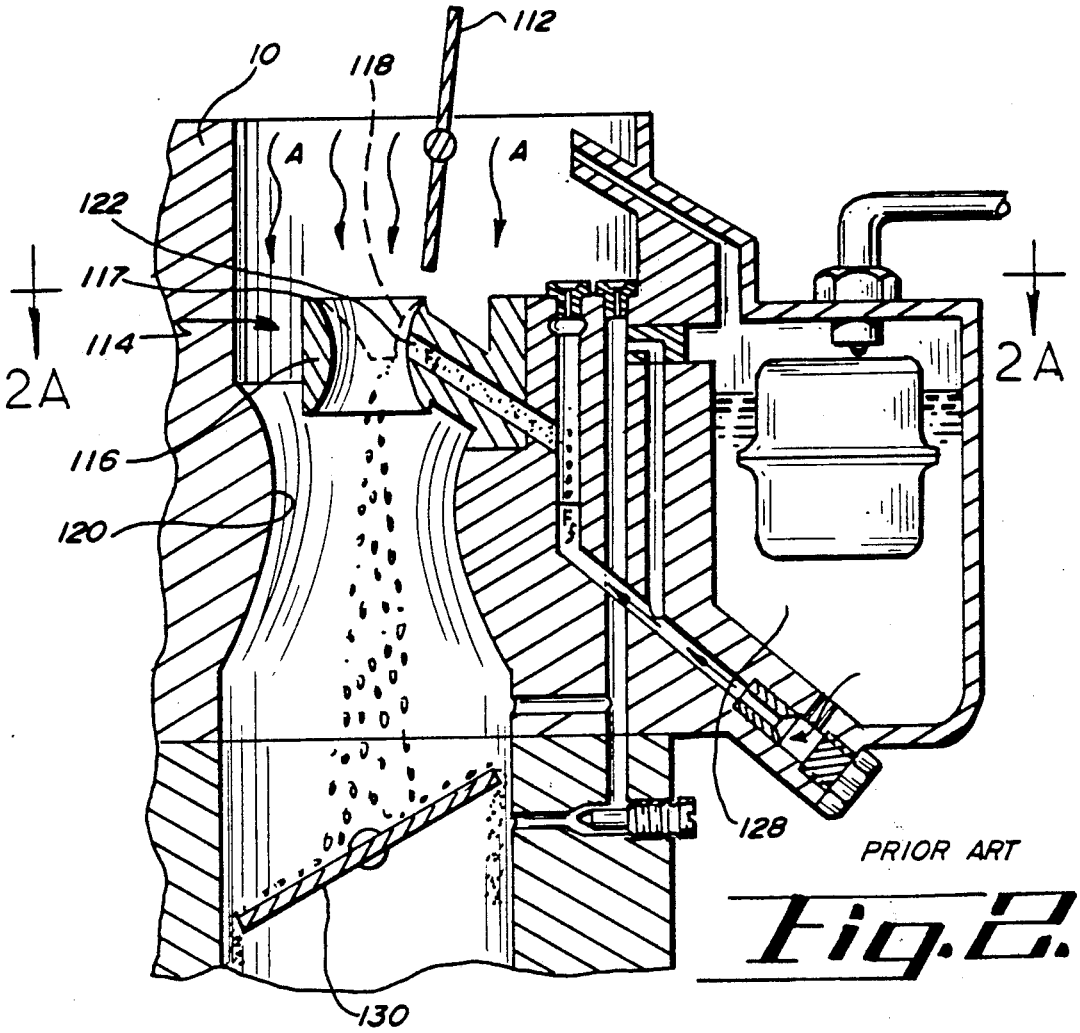
PRIOR ART Fig. 2.
FIG. 2 is a prior art cross-sectional schematic view of a CARTER or MOTOCRAFT carburetor.
Figure 2A:
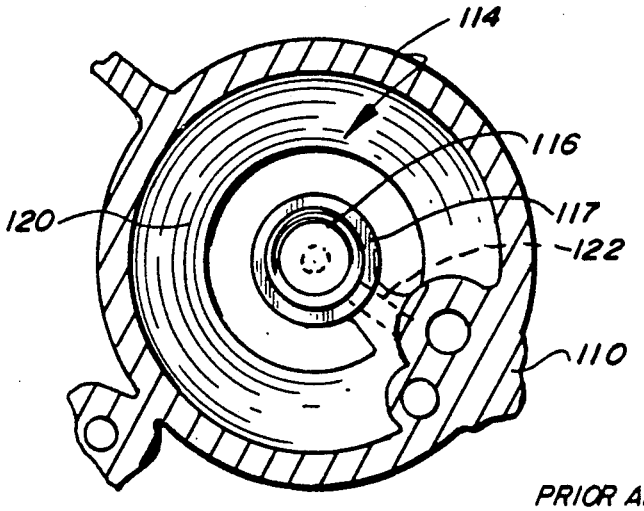
PRIOR ART Fig. 2A.
FIG. 2A is a cross-sectional view taken along lines 2A—2A of FIG. 2 showing the venturi stack partially broken away.
Figure 3:
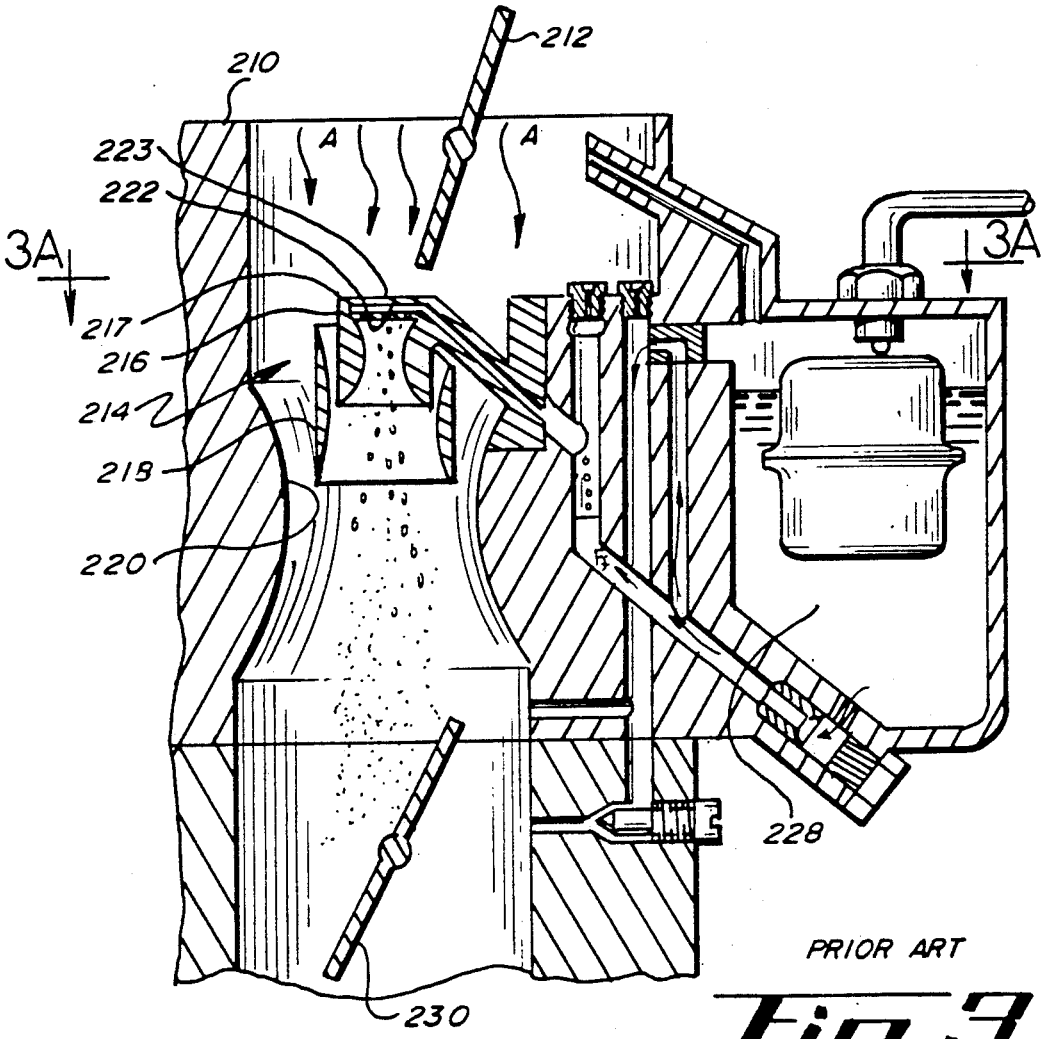
PRIOR ART Fig. 3.
FIG. 3 is a cross-sectional prior art schematic view of a HOLLY carburetor.
Figure 3A:
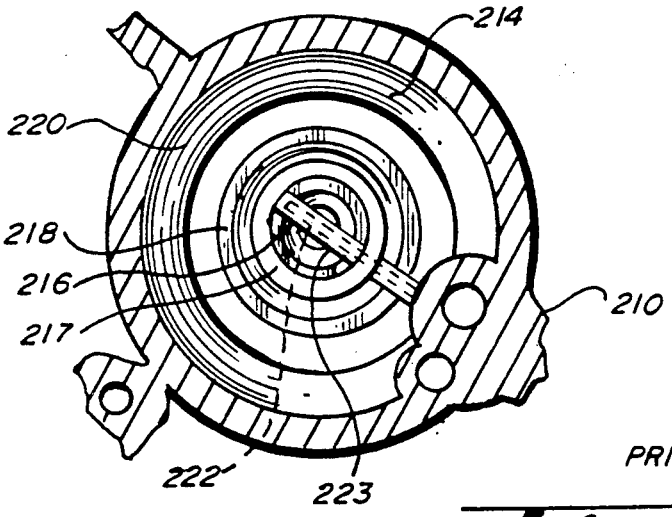
PRIOR ART Fig. 3A.
FIG. 3A is a cross-sectional view taken along lines 3A—3A of FIG. 3 showing the venturi stack partially broken away.
Figure 3B:
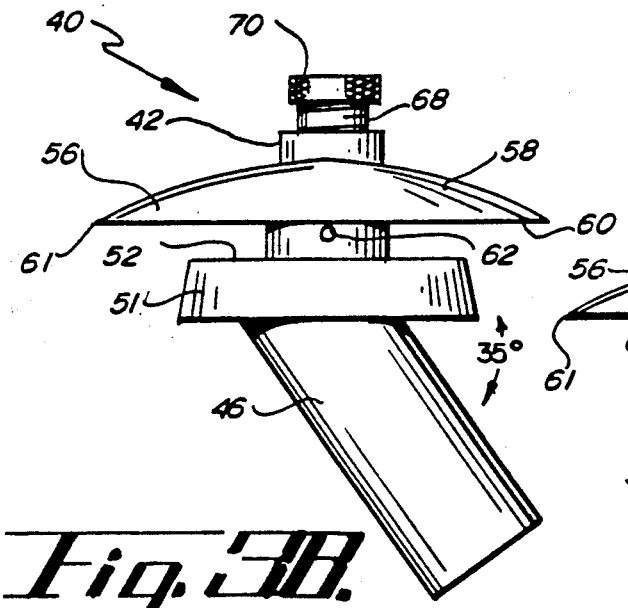
FIG. 3B is a side elevational view of one embodiment of the present invention and the same as FIG. 3 of the parent application as are FIGS. 4–11.
Figure 4:
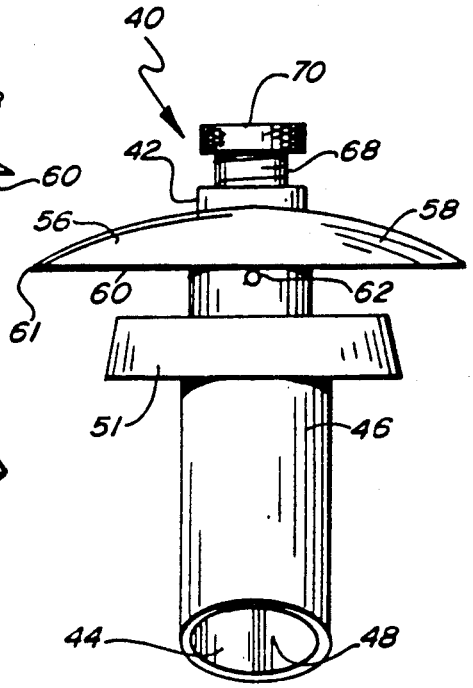
FIG. 4 is a rear elevational view of the invention.
Figure 5:
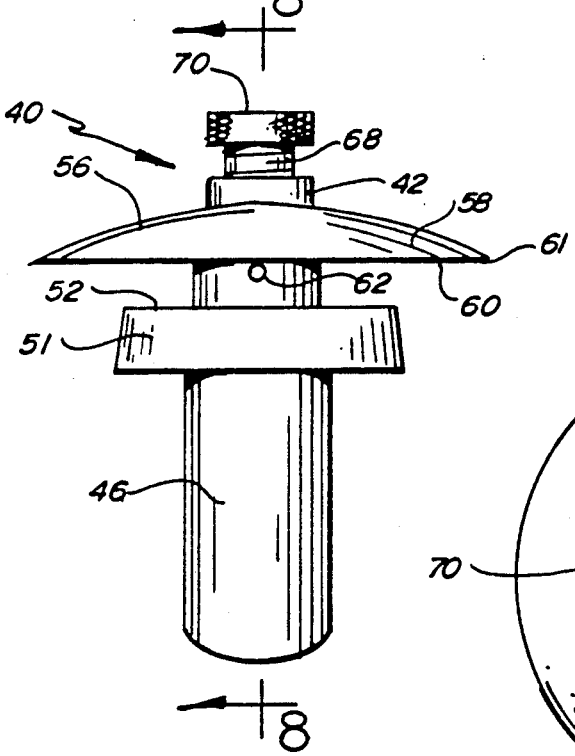
FIG. 5 is a front elevational view of the invention.
Figure 6:
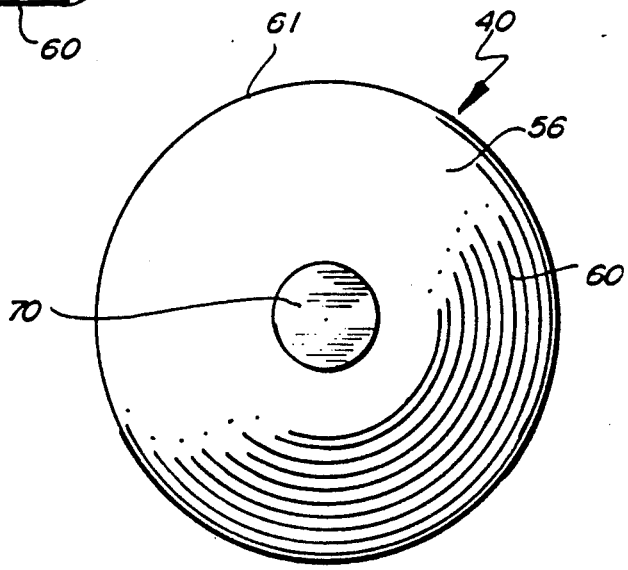
FIG. 6 is a top plan view of the invention.

Referring to FIGS. 3B through 9, one embodiment the fuel atomizing device 40 may generally be seen from the parent application. The device 40 generally includes a hollow body 42, a downwardly and outwardly projecting sleeve portion 46, a retaining cap 52, an atomizing disc 56, four radiating outwardly, equal distant apertures 62 in the body 42 and a set screw for constricting the flow communication through the apertures 62.

More particularly, hollow body 42 has a bottom surface 43 from which protrudes downwardly and outwardly the sleeve portion 46 which has a bottom opening 48. Hollow body 42 has conduit 44 extending therethrough and in communication with bottom opening 48. Sleeve portion 46 is approximately 35° from a horizontal plane.

Hollow body 42 has a first annular shoulder 50 which is centrally located on body 42 for concentrically supporting and affixing thereat a retaining cap 52 which has a downwardly projecting lip 51.

Body 42 has a second annular shoulder 54 for supporting and seating atomizing disc 56 which is preferably flexible and may be made from an elastomeric compound. Atomizing disc 56 preferably has a convex top surface 58 and a flat bottom surface or underside 60. Top and bottom surfaces 58 and 60 meet at the outer diameter or peripheral atomizing edge 61.

Body 42 has four equally spaced apertures 62 radiating outwardly below the atomizing disc 56 and above the retaining cap 52. Apertures 62 are in flow communication with conduit 44.

Hollow body 42 has a top opening 64 which suitably has a threaded inside wall 66. Set screw 68 appropriately is threadable within inside wall 66 and has a head 70 for adjustment of set screw 68 within top opening 64. Set screw 68, by this arrangement, may adjustably obstruct or close apertures 62 to control the flow of fuel from bottom opening 48, through conduit 44 and out apertures 62.

The construction of the venturi stack 14 and main discharge nozzle 22 of Rochester carburetors 10 are generally consistent in both dimensions and arrangements. Consequently, the following dimensions of the fuel atomizing device 40 have been found to work optimally with known carburetors 10 and are offered for purposes of illustration only.

The sleeve portion 46 suitably has an outer diameter of 0.250 inches with an inner diameter of 0.191 inches which readily permits the sleeve portion 46 to slide over the main discharge nozzle 22. Sleeve portion 46 is appropriately 35° from the horizontal to assure that the hollow body 42 and retaining cap 52 readily fits and seats upon top boost venturi 16 as sleeve portion 46 is fitted over main discharge or nozzle 22.

Securing means or retaining cap 52 suitably has an outer diameter of 0.556 inches with a lip 51 extending downwardly approximately 0.127 inches. By this arrangement, retaining cap will securely sit upon top boost venturi 16 while lip 51 assures that no gas leaks out of the top of the boost venturi 16 but must exit through apertures 62.

Atomizing disc 56 appropriately has an outer diameter of 0.875 inches. The disc is suitably flexible and made of an elastomeric compound which will permit it to flex downwardly under the air flow and vacuum action of the venturi stack 14 readily permitting the gas, which has a low viscosity, to readily atomize and be dispersed from outer diameter atomizing edge 61.

Four apertures 62 have been found to work well within hollow body 42 and suitably should have a diameter of 0.030 inches. Set screw 68 appropriately may be approximately ¼ inch in length and have a hand adjustable head 70 thereby permitting the set screw 68 to close down upon apertures 62 thereby adjusting the amount of gas to be dispersed upon the underside or bottom surface 60 of atomizing disc 56.

Figure 8:
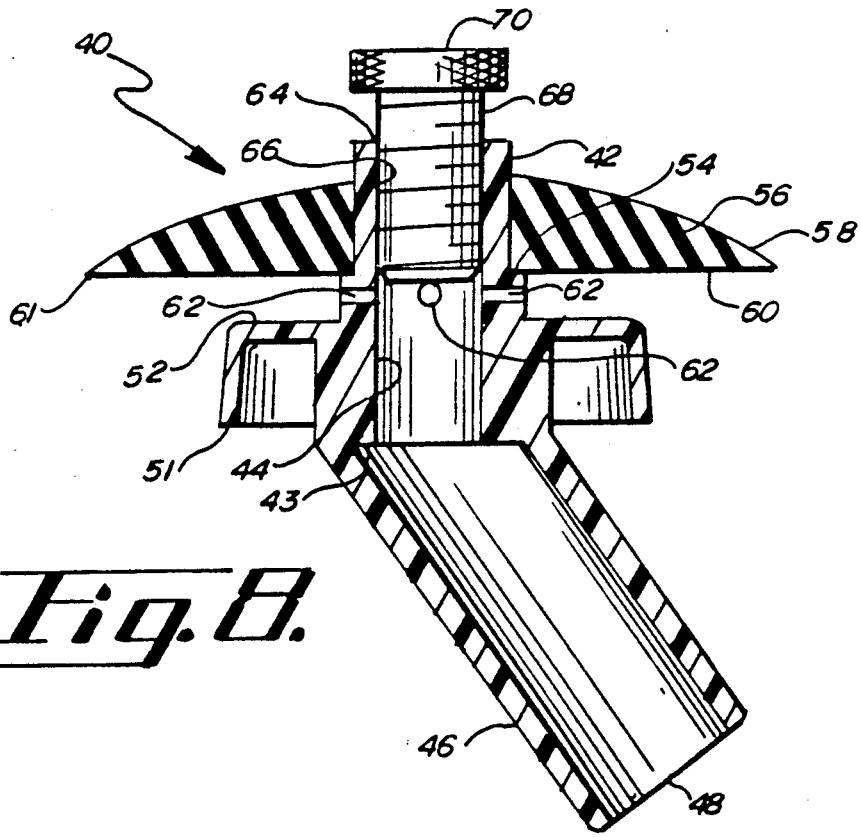
FIG. 8 is a cross-sectional view taken along lines 8—8 of FIG. 5 showing the fuel atomizing device of the present invention of a unitary or integral construction excepting the atomizing disc.
Figure 9:
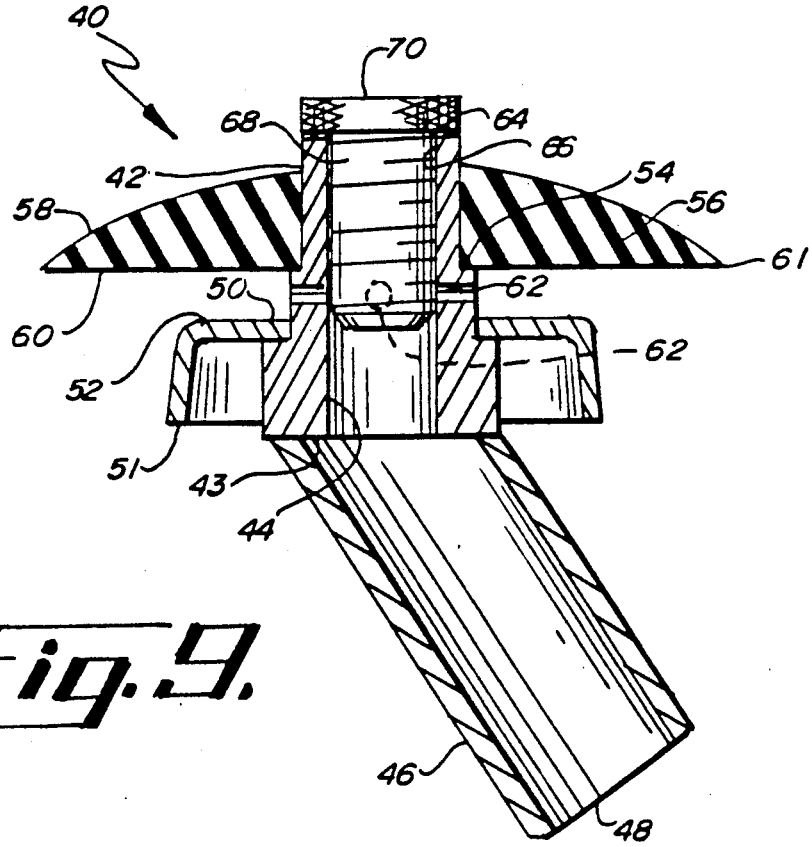
FIG. 9 is a similar view of FIG. 8 with the set screw adjusted downwardly closing the apertures and the device being made of assembled parts.

Fuel atomizing device 40, with the exception of atomizing disc 56, may be of a integral or unitary construction as shown in FIG. 8 and may be made of plastic suitably molded as is known. Atomizing device 40 may also be constructed of three components suitably affixed together and including the hollow body 42, retaining cap 52 and sleeve portion 46, as shown in FIG. 9.

Figure 11:
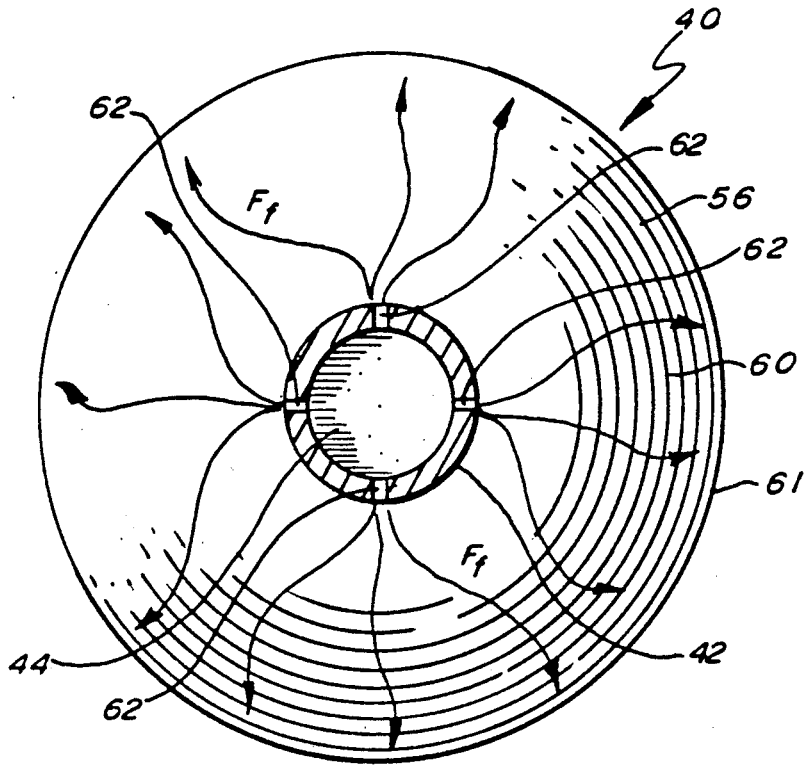
FIG. 11 is a cross-sectional view taken along lines 11—11 of FIG. 10.
Figure 7:
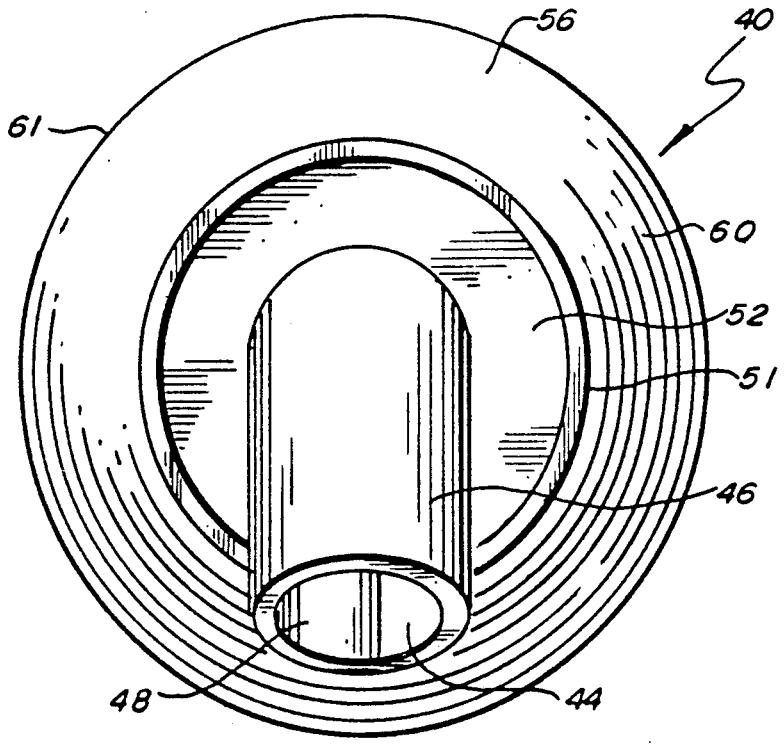
FIG. 7 is a bottom view of the invention.
Figure 10:
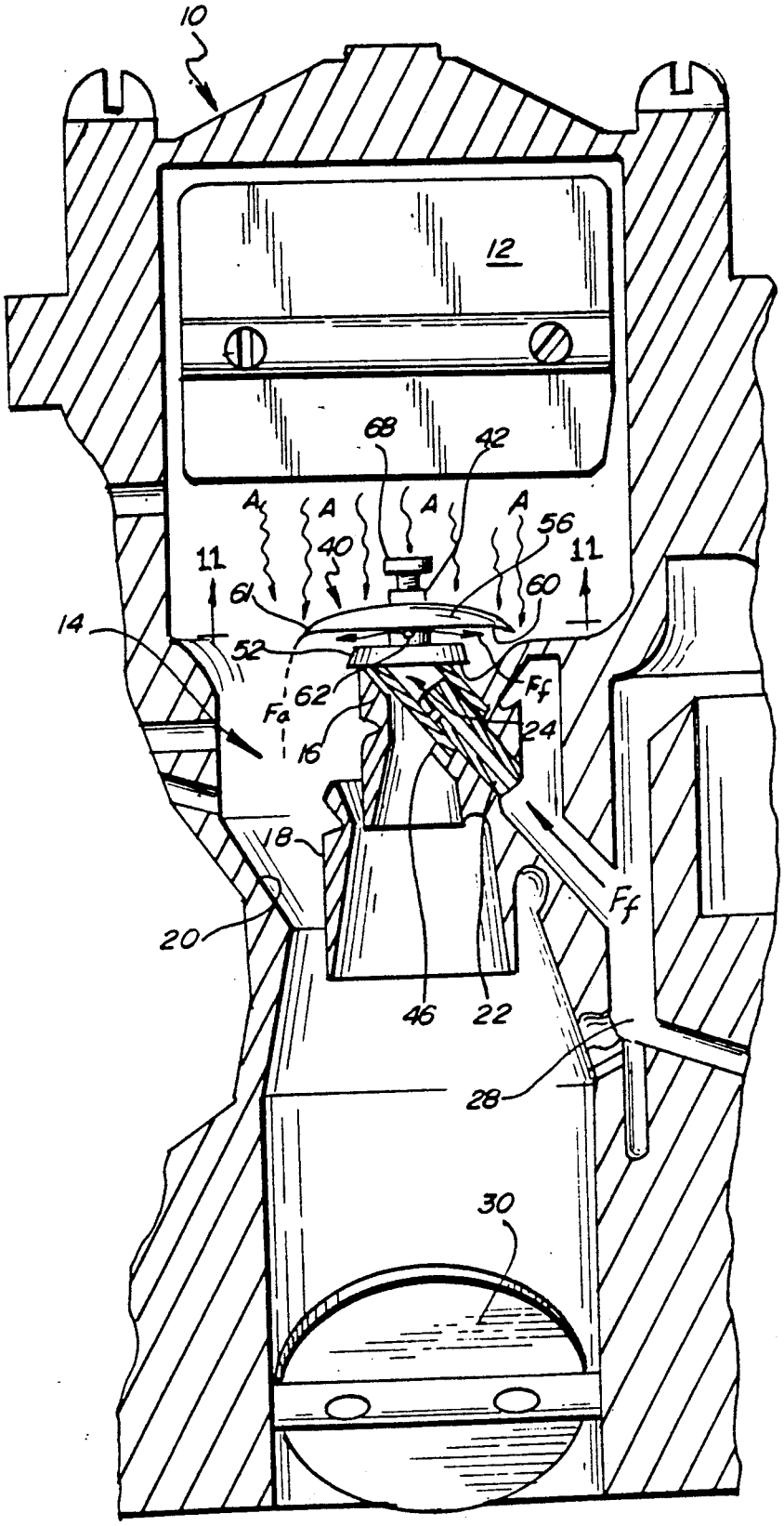
FIG. 10 is a cross-sectional vie of a ROCHESTER carburetor with the present invention installed and in operation with its sleeve portion partially cut away.
Figure 12:
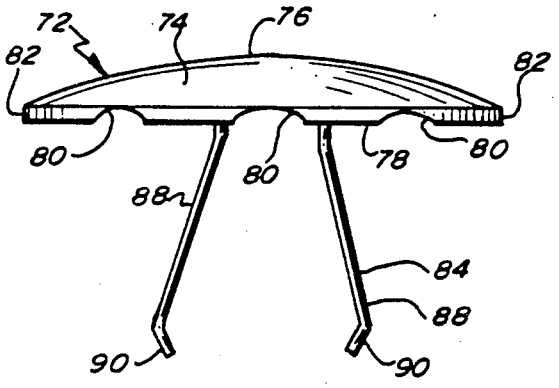
FIG. 12 is a front elevational view of another embodiment of the fuel atomizing device of the present invention.
Figure 14:
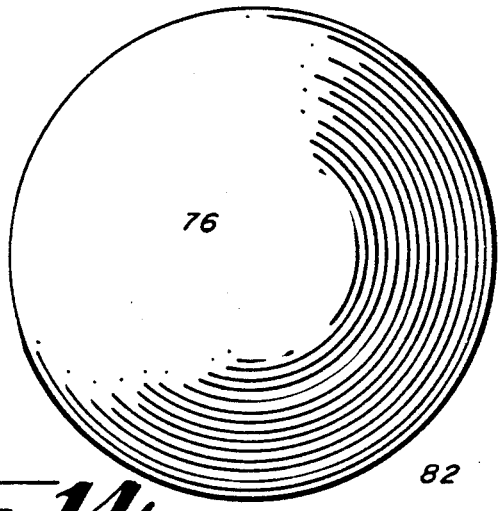
FIG. 14 is a top plan view of the invention.
Figure 13:
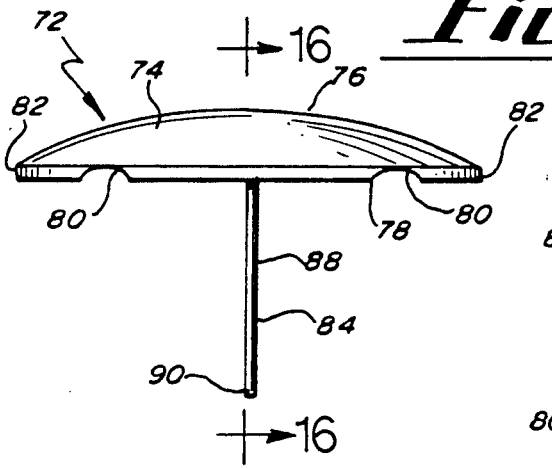
FIG. 13 is a side elevational view of the fuel atomizing device of the present invention.
Figure 15:
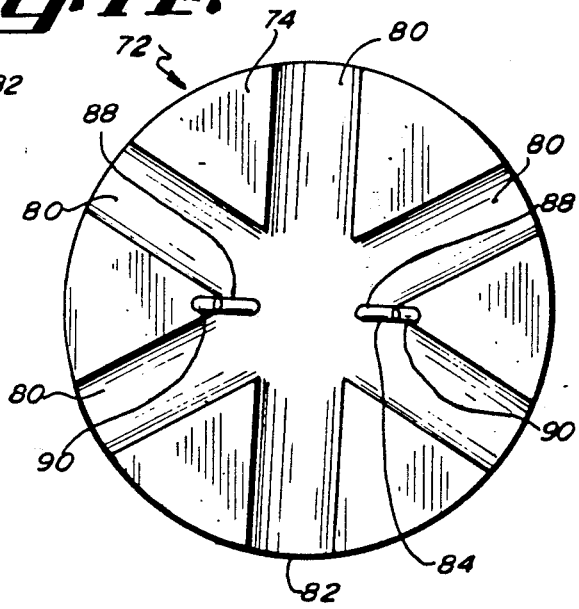
FIG. 15 is a bottom view of the fuel atomizing device.
Figure 16:
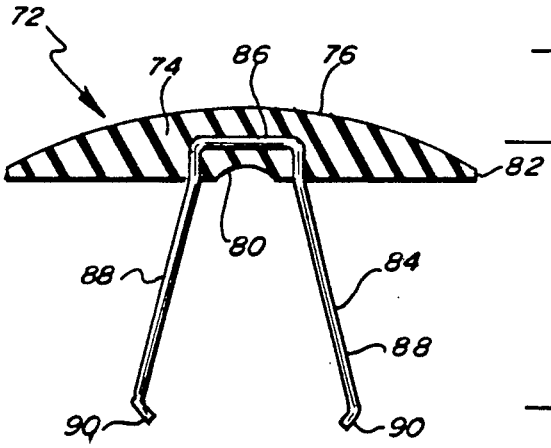
FIG. 16 is a cross-sectional view of the invention taken along lines 16—16 of FIG. 13.
Figure 17:
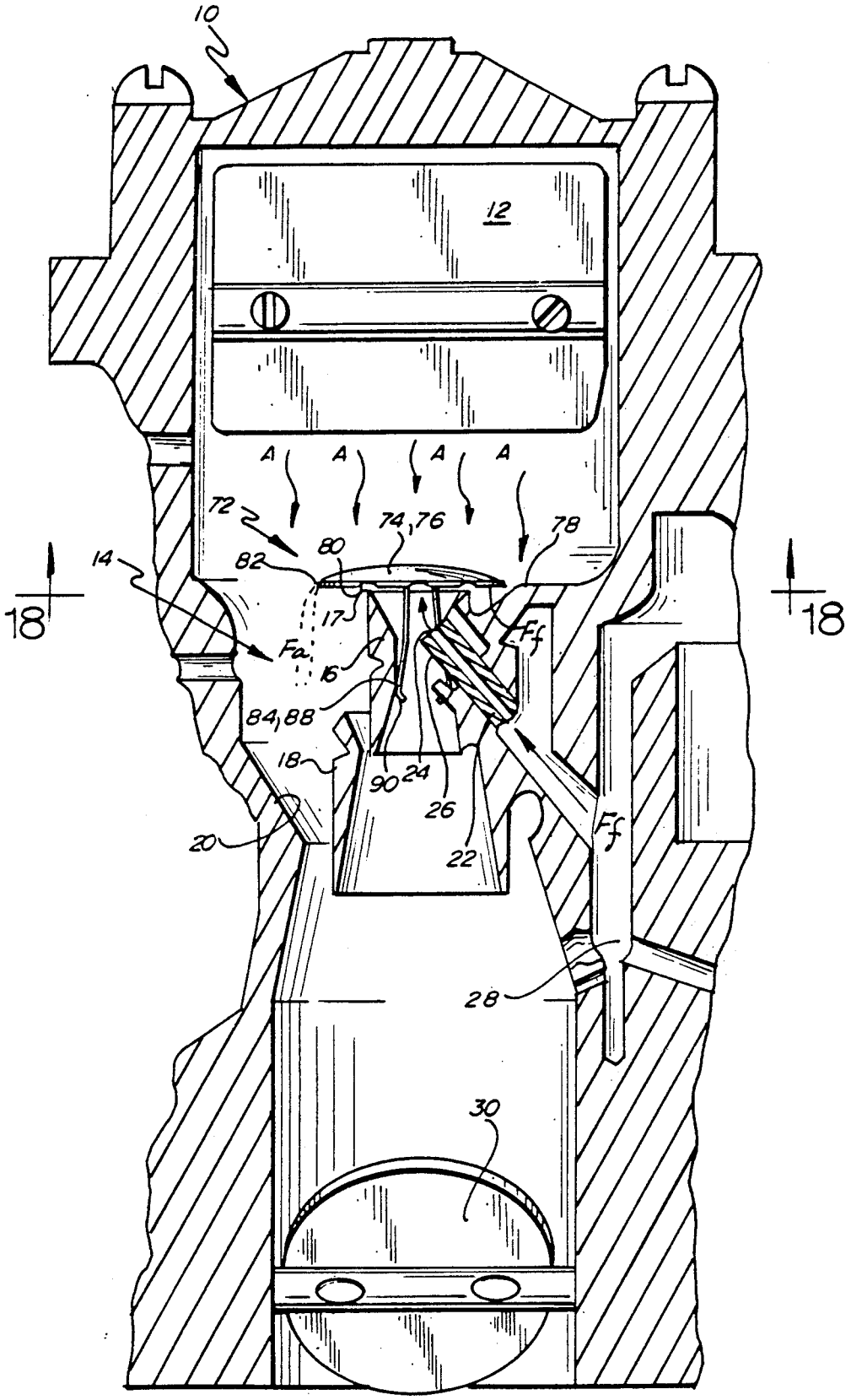
FIG. 17 is a cross-sectional schematic view of the ROCHESTER carburetor with the fuel atomizing device installed and operating.

Referring to FIGS. 10 and 11, the simple installation and operation of the fuel atomizing device 40 may be seen. Initially, the air valve 12 is opened and the fuel atomizing device 40 is grasped by the head 70 of screw 68 and the sleeve portion 46 of hollow body 42 is guided downwardly and over the main discharge nozzle 22 within the top boost venturi 16 of the Rochester venturi stack 14.

When the engine is operated, the piston and cylinders create a vacuum which draws air (arrow A) through the air valve 12 of carburetor 10 and by and through the venturi stack 14. The venturi arrangement creates a vacuum or air depression centrally with respect to the venturi stack 14 with the greatest depression generally located adjacent the main discharge nozzle 22. The gasoline or fuel in fluid form ($F_f$) is drawn (see arrows adjacent $F_f$) from the main well 28 by the vacuum or air depression, into nozzle 22, up through sleeve portion 46, into hollow body 42 and out apertures 62. Because gasoline has an extremely low viscosity and good dispersion qualities, the fuel readily disperses ($F_f$) out the four apertures and onto the flat bottom surface 60 of the atomizing disc 56 in an even manner (see FIG. 11).

As the incoming air (arrow A) impinges downwardly upon the convex top surface 58 of atomizing disc 56, the atomizing disc 56, when made from an elastomeric compound, is somewhat flexed downwardly along its outer diameter atomizing edge 61. Also a further vacuum is created under the atomizing disc 56 along the bottom surface 60 adjacent the atomizing edge 61 which draws the liquid fuel or gas (arrow $F_f$) outwardly to the atomizing edge 61. At edge 61, the localized vacuum, incoming air (arrow A) and associated air turbulence literally rips and atomizes the liquid fuel or gas off the outer diameter atomizing edge 61 ($F_a$). The atomized fuel is next carried through the carburetor beyond the throttle valve 30 into the engine.

Depending upon the particular carburetor and engine, the set screw 68 may be adjusted by means of turning the head 70 to adjust the constriction or obstruction of apertures 62 until the engine operates efficiently and with good performance throughout various operating conditions.

Referring to FIGS. 12–16, a modified yet simpler version of the fuel atomizing device 72 may be viewed. As in the parent fuel atomizing device 40, the critical element of the fuel atomizing device 56 or 72 is the atomizing disc 56 or 74. That is, the atomizing disc 56 or 74 must be concentrically supported by securing means on the top lip 17, 117 or 217 of known carburetors 10, 110 or 210 or their equivalents.

Suitably, the atomizing disc 56 or 74 is made from an elastomeric compound, such as the well known rubber product called Nitrile which is not a trademark but a known industry composition of elastomer. Nitrile is beneficial in that it is resistant to deterioration under the repeated contact with gasoline or alcohol while yet retaining its elastomeric characteristics over a long life. However, other elastomeric compounds suitably may work and even a rigid atomizing disc will offer some benefit and produce the objects and advantages desired.

The simplified fuel atomizer device 72 includes the atomizing disc 74 suitably with an inverted "U" shaped imbedded mounting spring or pin 84. Atomizing disc 74 appropriately has a top surface 76 and a flat bottom surface 78 which converge toward atomizing edge 82. Top surface 76 has been found to work best if it is convex in shape. Tunnels, grooves or channels 80 suitably may be placed in the bottom flat surface 78 and arranged to radiate axially from the central region of the bottom surface 78. Suitable securing means comprise an imbedded mounting spring 84 which may have a top inverted "U" section 86 adaptable for molding into the atomizing disc 74. Spring 84 also has outwardly depending legs 88 with inwardly depending feet 90 at the end of legs 88.

Strickly for illustration purposes, the disc may have an outer diameter of 0.8125 inch with a height of 0.093 inch. These dimensions work well with known carburetors.

Referring to FIGS. 17–20, the installation and operation of the simplified fuel atomizing device 72 may be appreciated. Device 72 is universal in that it will fit any of the Rochester, Carter, Motocraft, or Holly carburetors 10, 110, or 210, respectively, or their equivalents. Initially, the air valve or butterfly 12, 112 or 212 is manually opened. Thereafter, the depending legs 88 of spring 84 are pinched together and held as the inwardly depending feet 90 are guided into the top or innermost boost venturi 16, 116 or 216. Once the feet 90 are within the boost venturi, the installer simply pushes downwardly on the atomizing disc 74 until the flat bottom surface 78 horizontally rests on the top lip 17, 117 or 217 of the particular carburetor. Spring legs 88 together with the downward air flow (arrow A) hold the device securely in place.

Either during installation or by way of rotating the fuel atomizing device 72, the depending legs 88 appropriately should be oriented to straddle the main gasoline discharge 22, 122 or 222 to avoid interference with the stream of liquid fuel ($F_f$) as it is drawn upwardly within the venturi stack 14, 114 and 214 by action of the atomizing disc 74 similarly as explained for atomizing disc 56.

Figure 18:
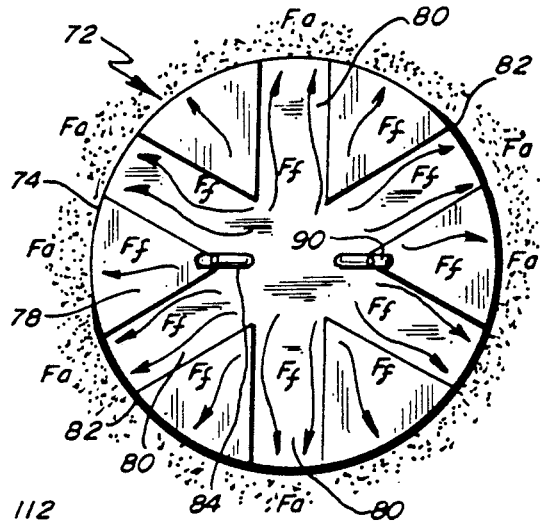
FIG. 18 is a cross-sectional view of the invention taken along lines 18—18 of FIG. 17.
Figure 19:
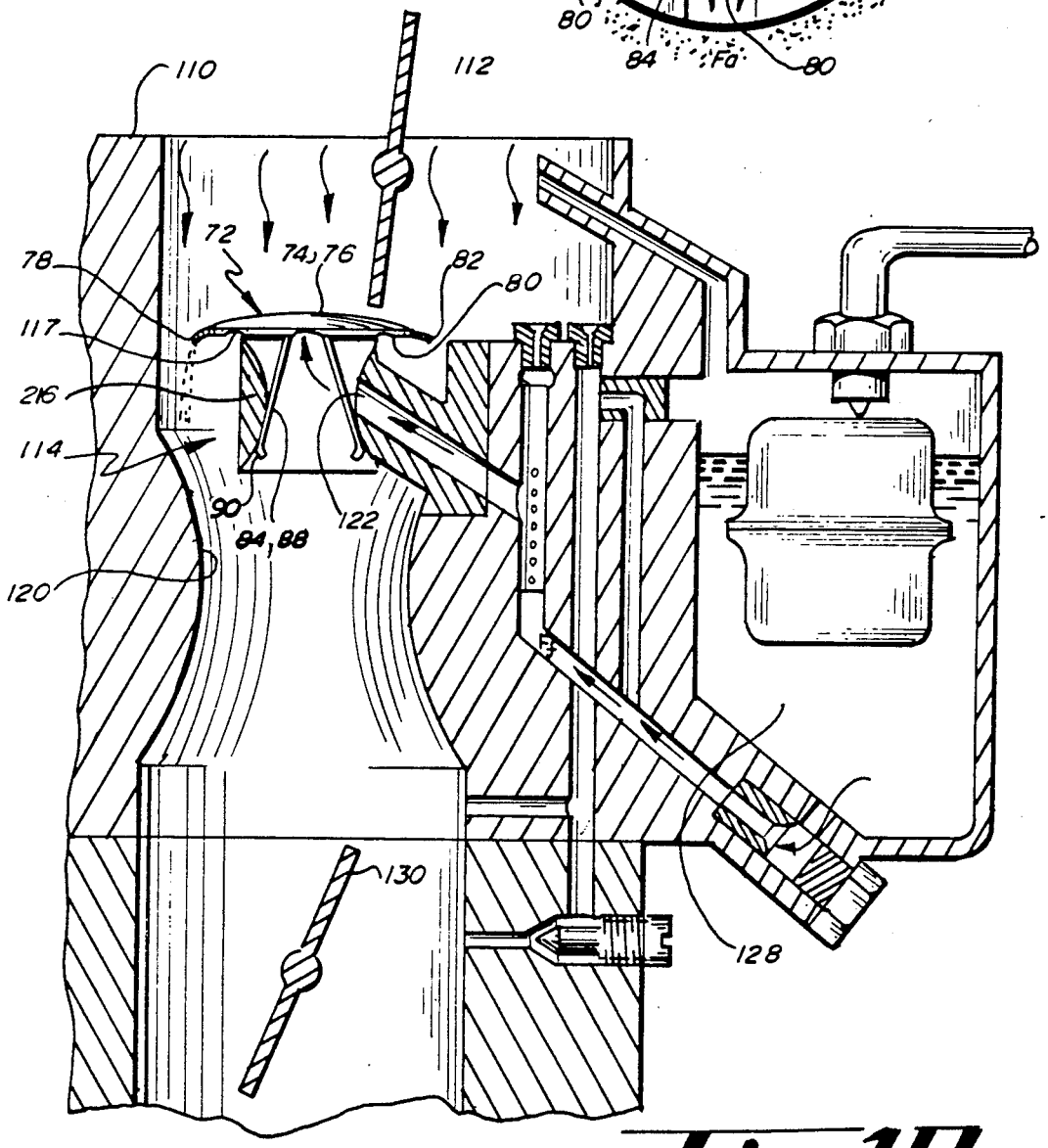
FIG. 19 is a cross-sectional schematic view of the CARTER or MOTOCRAFT carburetor with the fuel atomizing device installed and operating.
Figure 20:
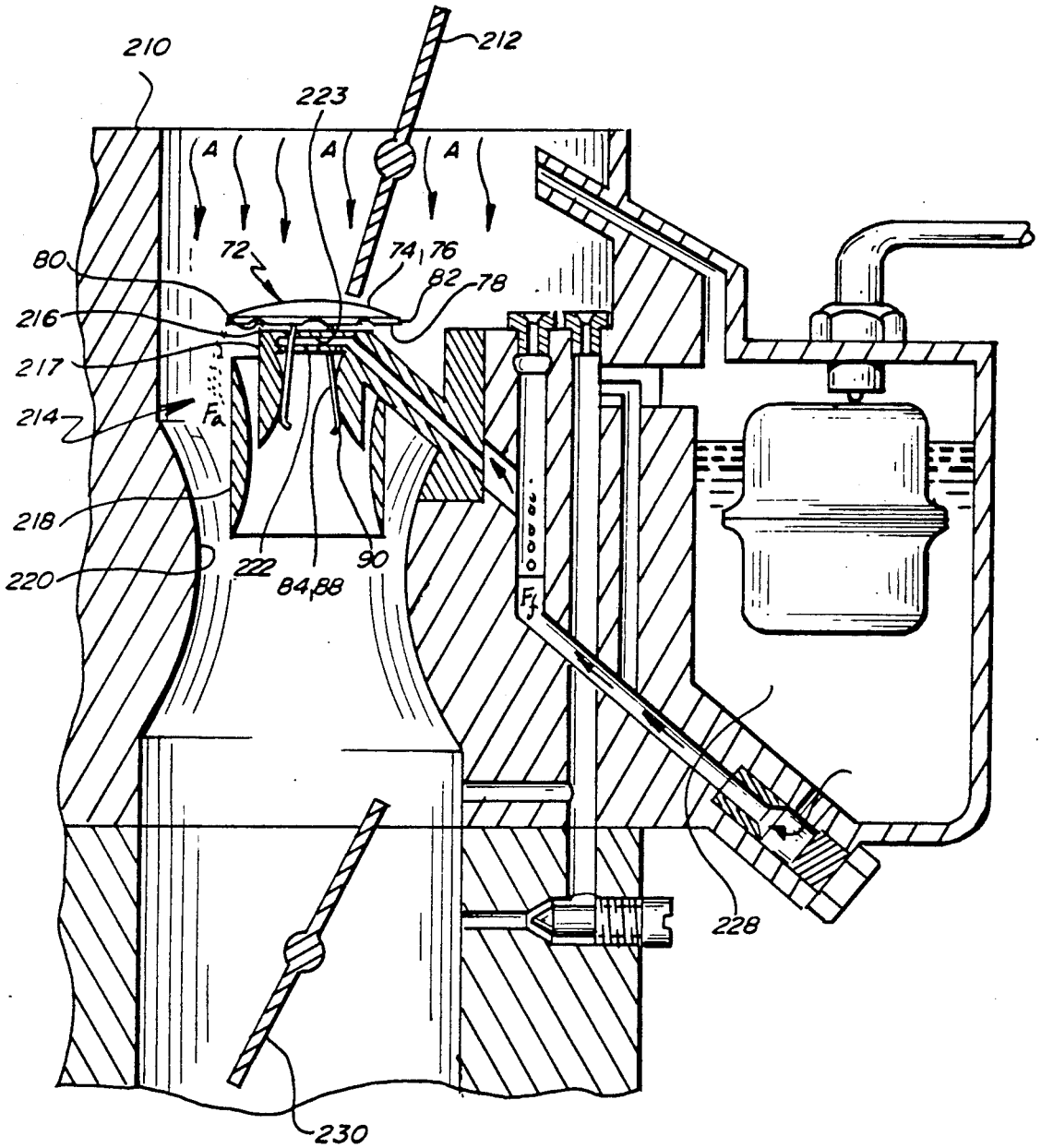
FIG. 20 is a cross-sectional schematic view of the HOLLY carburetor with the fuel atomizing device installed and operating.

The tunnels, grooves or channels 80 on the bottom surface 78 will assure that the bottom surface 78 of the atomizing disc 74 will not seal upon the top lip 17, 117 and 217 of any of the various carburetors 10, 110 and 210. By this arrangement, the liquid fuel or gasoline ($F_f$) will be drawn upwardly to the bottom surface 78 by action of the vacuum or depression within the venturi stack 14, 114, or 214 and radiate axially outwardly as shown in FIG. 18. The view of FIG. 18 is similar for all three carburetors shown in FIGS. 17, 19 and 20.

As the incoming air (Arrow A) impinges downwardly on the convex top surface 76 of the atomizing disc 74, the elastomeric disc may somewhat deflects downwardly along its outer diameter atomizing edge 61. However, such is not the case with a rigid disc 74. At the atomizing edge 82, the localized vacuum, associated air turbulence and downwardly rushing incoming air (arrow A) literally rips and atomizes the liquid fuel or gas off the outer diameter atomizing edge 82 ($F_a$). The atomized fuel is next carried through the carburetor 10, 110 or 210 beyond the throttle valve 30, 130 or 230 into the engine.

At any time, the atomizing device 72 may be removed from the carburetor 10, 110 or 210 by simply opening the butterfly 12, 112 and 212 and manually grasping the atomizing disc 74 and pulling it upwardly and out of the carburetor. The carburetor needs no modifications or adjustments to operate the fuel atomizing device 72 therein. Also, the device 72 has a low enough profile to be free of obstruction of the air valve or butterfly 12, 112 and 212. Mileage improvements in the range of 20–35% may be appreciated with this device along with noticeable improvements in power, acceleration and smooth running of the engine.

The present invention may be embodied in other specific forms without departing from the spirit or essential attributes thereof; and it is therefore desired that the present embodiment be considered in all respects as illustrative and not restrictive, reference being made to the appended claims rather than to the foregoing description to indicate the scope of the invention.

What is claimed:

1. A universal fuel atomizing device for carburetors which have a fuel discharge located within a venturi stack with at least one boost venturi with a top lip that requires no carburetor adjustment, removal or disassembly, comprising:

(a) a fuel atomizing disc having top and bottom surfaces and an outer diameter atomizing edge, (b) securing means for concentrically seating and holding the disc on the boost venturi whereby the disc draws fuel from the discharge, onto the bottom surface and towards the outer diameter atomizing edge from which the fuel is atomized by action of the localized vacuum, the air flow through the carburetor and the air turbulence at the atomizing edge.

2. The fuel atomizing device of claim 1, wherein the atomizing disc is elastomeric.

3. The fuel atomizing device of claim 1, wherein the atomizing disc has a convex top surface.

4. The fuel atomizing device of claim 1, wherein the atomizing disc is flexible.

5. The fuel atomizing device of claim 1, wherein the atomizing disc has a flat bottom surface.

6. The fuel atomizing device of claim 1, wherein the atomizing disc is horizontally seated on the venturi stack.

7. The fuel atomizing device of claim 1, wherein the atomizing disc is seated on the top lip.

8. The fuel atomizing device of claim 1, wherein the atomizing disc has a diameter greater than the boost venturi.

9. The fuel atomizing device of claim 1, further comprising axially radiating grooves on the bottom surface of the atomizing disc.

10. The fuel atomizing device of claim 1, wherein the securing means comprises a mounting spring imbedded within the atomizing disc having downwardly and outwardly depending legs.

11. The fuel atomizing device of claim 10, further having inwardly depending feet on the outwardly depending legs.

12. The fuel atomizing device of claim 1, where the atomizing disc is made from Nitrile.

13. A universal fuel atomizing device for carburetors which have a fuel discharge located within a venturi stack with at least one boost venturi with a top lip that requires no carburetor adjustment, removal or disassembly, comprising:

(a) a fuel atomizing disc having convex top and substantially flat bottom surfaces, axially radiating grooves on the bottom surface and an outer diameter atomizing edge, and (b) securing means for concentrically seating and holding the disc on the top lip of the boost venturi whereby the disc draws fuel from the discharge, onto the bottom surface and towards the outer diameter atomizing edge from which the fuel is atomized by action of the localized vacuum, the air flow through the carburetor and the air turbulence at the atomizing edge.

14. The fuel atomizing device of claim 13, wherein the atomizing disc is elastomeric.

15. The fuel atomizing device of claim 13, wherein the atomizing disc is horizontally seated on the venturi stack.

16. The fuel atomizing device of claim 13, wherein the securing means comprises a mounting spring imbedded within the atomizing disc having downwardly and outwardly depending legs.

17. The fuel atomizing device of claim 16, further having inwardly depending feet on the outwardly depending legs.

18. The fuel atomizing device of claim 13, where the atomizing disc is made from Nitrile.

* * * * *